US006145801A

United States Patent [19]

Herring, Jr.

[11] Patent Number: 6,145,801

[45] Date of Patent: Nov. 14, 2000

[54] ATTACHABLE AND FOLDING INSTRUMENT CASE STAND

[76] Inventor: Marion K. Herring, Jr., 1400 Thomason St., Lexington, N.C. 27292

[21] Appl. No.: 09/227,988

[22] Filed: Jan. 8, 1999

Related U.S. Application Data

[60] Provisional application No. 60/071,823, Jan. 20, 1998.

[51] Int. Cl.[7] ..... A47B 97/04

[52] U.S. Cl. ..... 248/463; 211/85.6; 248/150; 248/443; 248/688

[58] Field of Search ..... 248/166, 443, 248/460, 448, 96, 97, 95, 447, 462, 463, 464, 465; 84/327, 453; 211/85.6, 195

[56] References Cited

U.S. PATENT DOCUMENTS

| | | | |
|---|---|---|---|
| 1,612,148 | 12/1926 | Oettinger | 211/85.6 |
| 2,751,176 | 6/1956 | Mowry | 248/96 |
| 2,945,657 | 7/1960 | Jarman | 248/96 |
| 3,195,844 | 7/1965 | Roepke | 248/96 |
| 3,459,434 | 8/1969 | Dulaney | 280/38 |
| 3,847,335 | 11/1974 | Ross | 248/166 |
| 3,866,877 | 2/1975 | Thompson | 248/688 |
| 3,958,786 | 5/1976 | Mann | 248/176 |
| 4,620,682 | 11/1986 | Yim | 248/96 |
| 4,913,460 | 4/1990 | Klein | 280/646 |
| 4,925,147 | 5/1990 | Potter | 248/463 |
| 4,936,598 | 6/1990 | Lee | 280/645 |
| 5,040,762 | 8/1991 | Potter | 248/460 |
| 5,074,577 | 12/1991 | Kim | 280/646 |
| 5,180,184 | 1/1993 | Chiu | 280/646 |
| 5,197,701 | 3/1993 | Olson | 248/166 |
| 5,351,983 | 10/1994 | Descalo | 280/646 |
| 5,415,285 | 5/1995 | Reimers | 206/315.7 |
| 5,437,423 | 8/1995 | Sinclair | 248/96 |
| 5,573,211 | 11/1996 | Wu | 248/96 |
| 5,582,372 | 12/1996 | Wu | 248/96 |
| 5,597,144 | 1/1997 | Lee | 248/96 |
| 5,718,401 | 2/1998 | Walters | 248/150 |
| 5,829,585 | 11/1998 | Kao et al. | 20/315.3 |
| 5,887,833 | 3/1999 | Sundara et al. | 248/96 |
| 5,904,326 | 5/1999 | Riu | 248/96 |

*Primary Examiner*—Ramon O. Ramirez
*Assistant Examiner*—Tan Le

[57] ABSTRACT

A folding instrument case stand attachable to the instrument case to support the case in an upright, tilted position. The stand is particularly adaptable for use with a stringed instrument case, for example a guitar case. The stand has spring loaded diverging legs that are pivotal relative to a central frame between a folded and an extended position. Straps extend from tie down plates mounted on the central frame to secure the base of the instrument case to the stand. The spring loaded legs can be latched to the central frame in the folded configuration. When the legs are in the folded configuration the stand can be transported with the instrument case. The case and stand can also be used as a temporary support for the musical instrument with the case opened and with the frame in an extended configuration.

15 Claims, 11 Drawing Sheets

( LEGS UNFOLDED )

( LEGS FOLDED )

( LEGS UNFOLDED )

( LEGS UNFOLDED )

( LEGS FOLDED )

( LEGS UNFOLDED )

( LEGS FOLDED )

ATTACHABLE AND FOLDING INSTRUMENT CASE STAND

CROSS REFERENCE TO RELATED APPLICATIONS

Applicant claims the benefit of previously field Provisional Patent Application Ser. No. 60/071,823, filed Jan. 20, 1998

BACKGROUND OF THE INVENTION

1. Field of the Invention

This invention relates to a folding stand that can be strapped to a musical instrument case, such as those for guitars and other stringed instruments, as well as other instruments.

2. Description of the Prior Art

Musicians of stringed instruments usually have at least two problems; where to put their instrument case and where to put their instrument when they have finished playing. Stringed instrument stands, such as guitar stands, have typically been awkward to use. A musician must carry his or her guitar and stand and then find a place where their guitar stand and case will not be in the way when playing or performing. Also, guitars on typical stands are unprotected from falls or accidents. Transportation and storage is another concern. A musician on the go must carry both their guitar and its stand. Having so many things to carry can be very encumbering. Then, one must find a corner of a room, or some other prop against which to lean the guitar case, adding additional inconvenience.

SUMMARY OF THE INVENTION

This invention is directed to a folding stand that can be attached to the back of a musical instrument case, such as those made for guitars. An object of the present invention is to provide a stand which can be easily attached to most guitar and stringed instrument cases whit little or not modifications to the case, with the added convenience of spring loaded, folding legs that enable the instrument case to stand freely on its own without the need for walls or other props.

The attachable stand comprises steel tubing that is welded or otherwise attached to create a unit with folding legs, which are spring loaded. The legs can be released by a button that is located under the handle at the top of the stand. The stand attaches to the instrument case via web straps and associated hardware. A retrofit caster kit will provide the added convenience of being able to pull the stand and instrument case like a cart.

DETAILED DESCRIPTION OF THE PREFERRED EMBODIMENT

Figure 1:
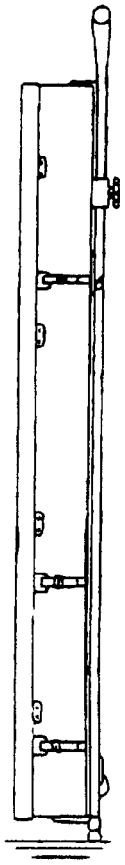
FIG. 1 is side view of the attachable, folding instrument case stand in the folded position, attached to the back of a guitar case.

The folding instrument case stand comprising the preferred embodiment of this invention comprises a central frame 16 with a top tie down plate 7 attached to the central frame below a handle 9 located at the top of the central frame 16. A bottom tie down plate 8 is attached to the central frame 16 below the top tie down plate and above two small support legs 17 that extend at angles from the bottom of the central frame 16. In the preferred embodiment the central frame comprises a ½"×1' 16 gauge steel hollow tube having a length of approximately 44".

Figure 13:
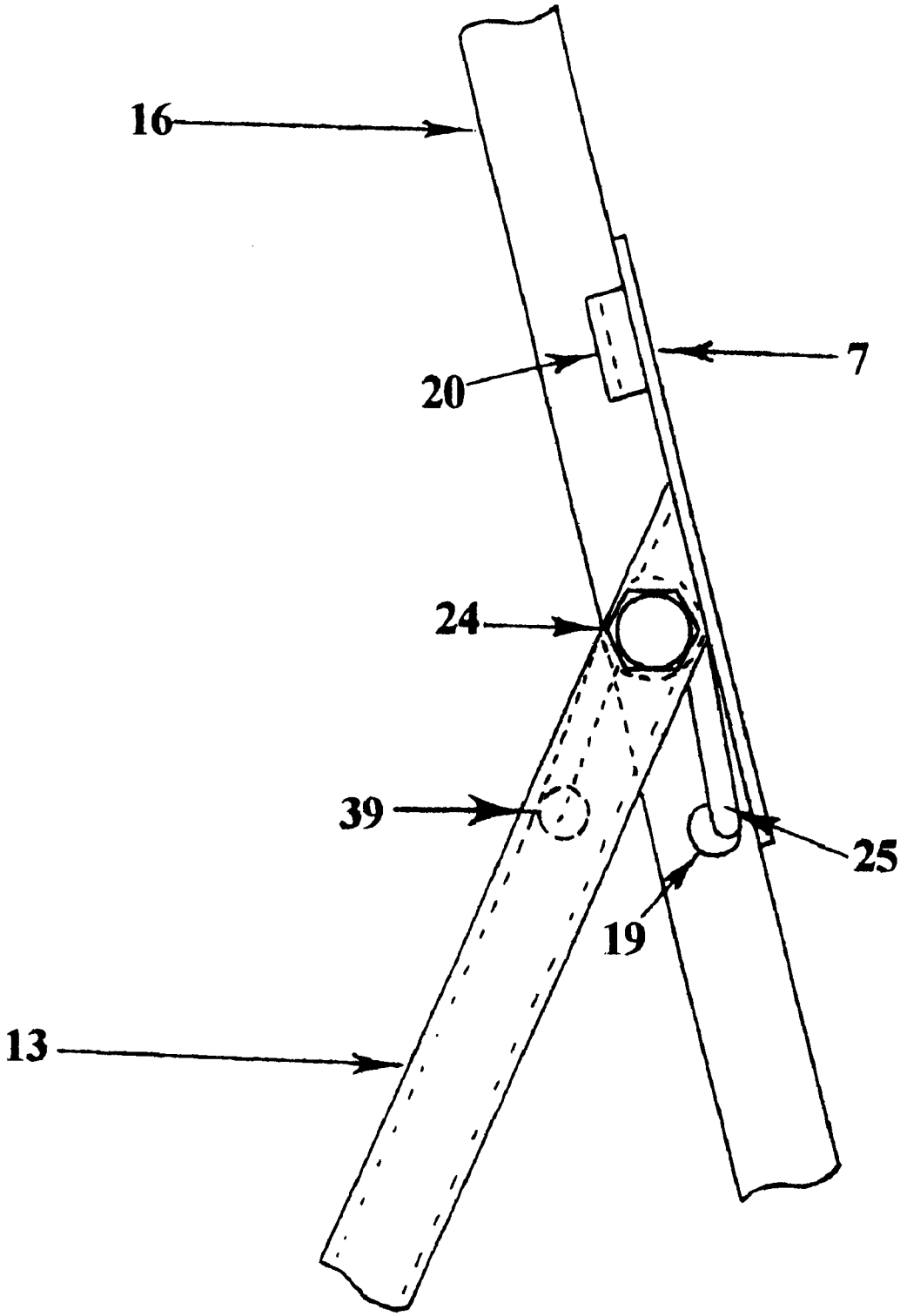
FIG. 13 is a partial side view showing the manner n which the swing out legs are attached to the central frame adjacent to the top tie down plate.
Figure 14:
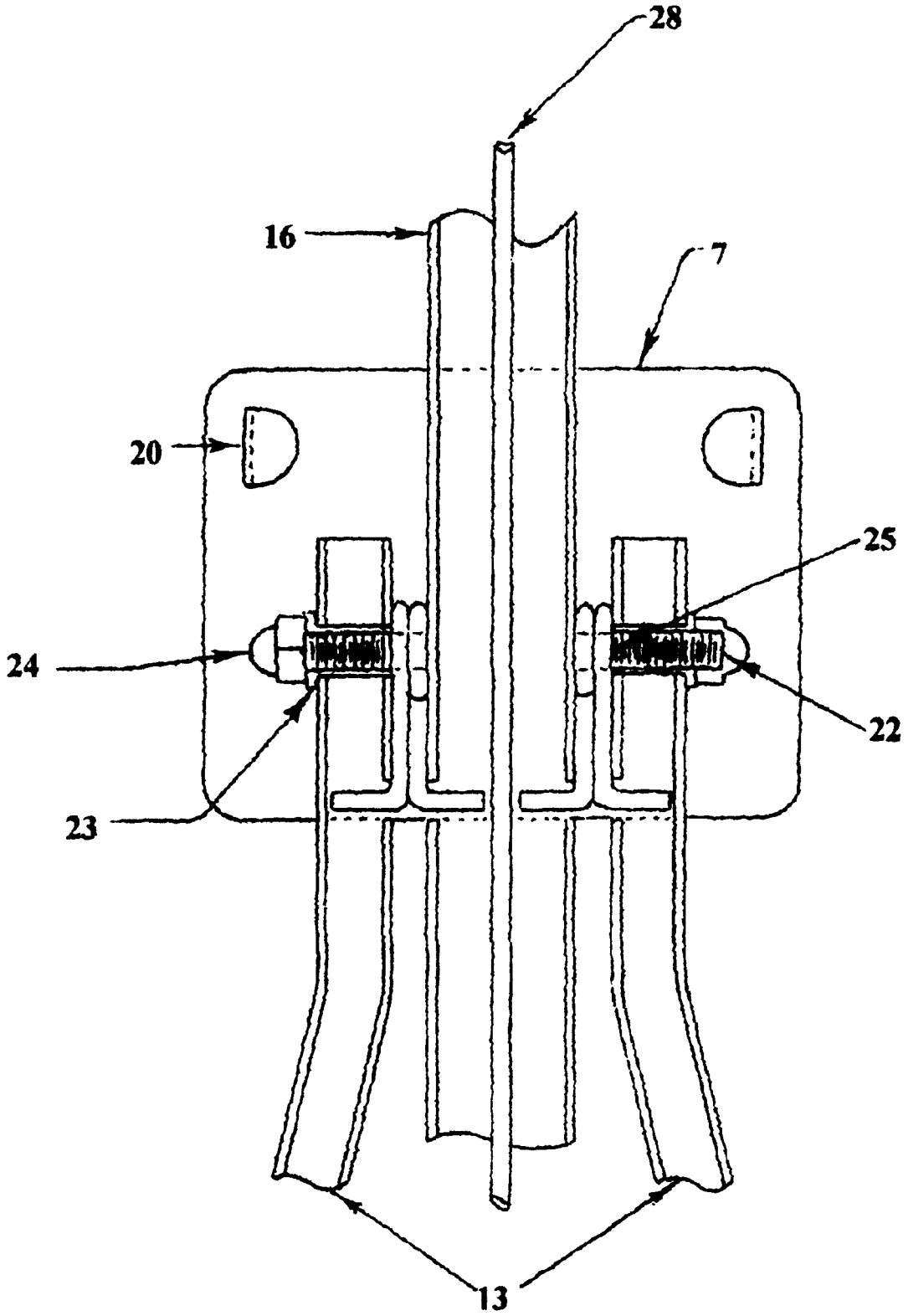
FIG. 14 is a rear view of the area shown in FIG. 13 showing the manner in which the two swing out legs are attached to the tubular central frame.
Figure 15:
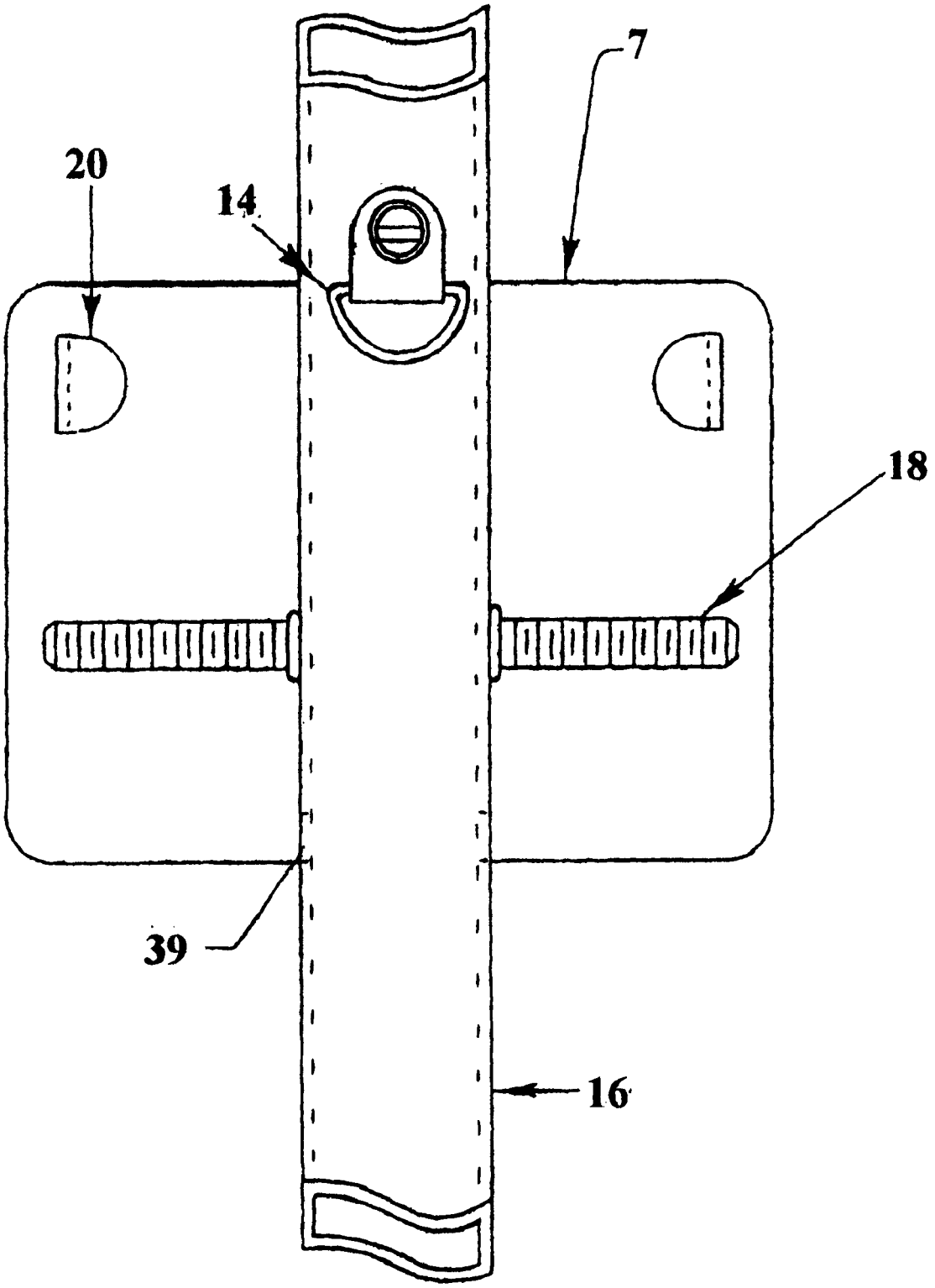
FIG. 15 is a view of the top tie down plate attached to the central frame.
Figure 16:
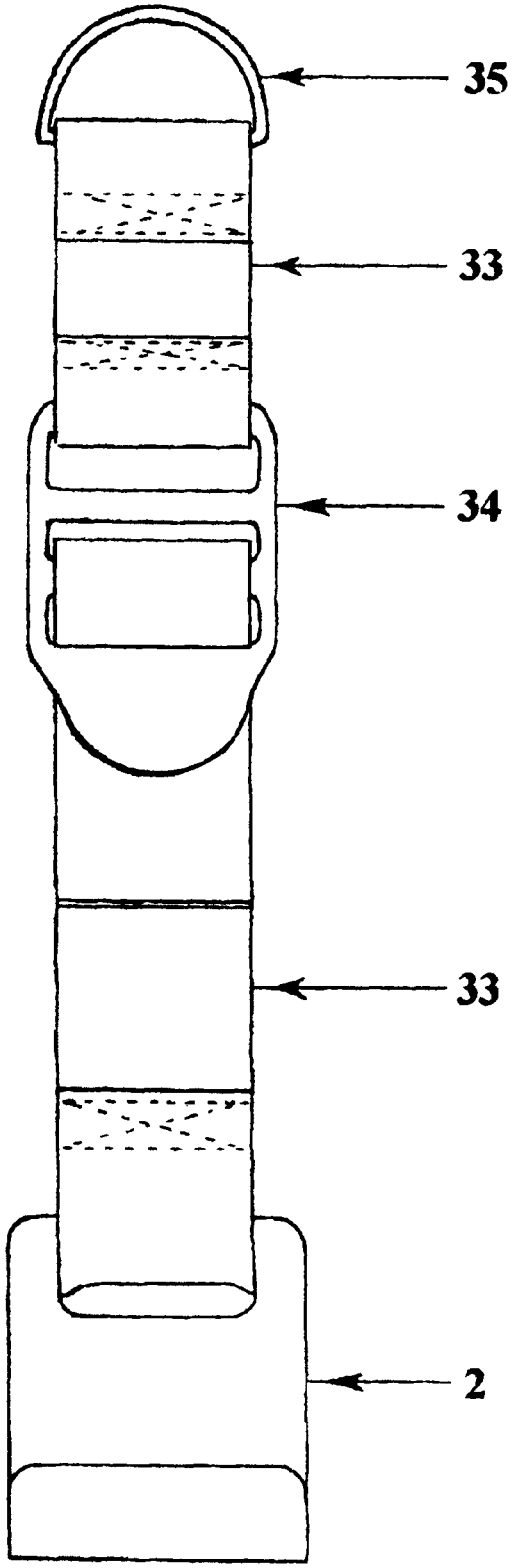
FIG. 16 is a view of an attachment strap.
Figure 17:
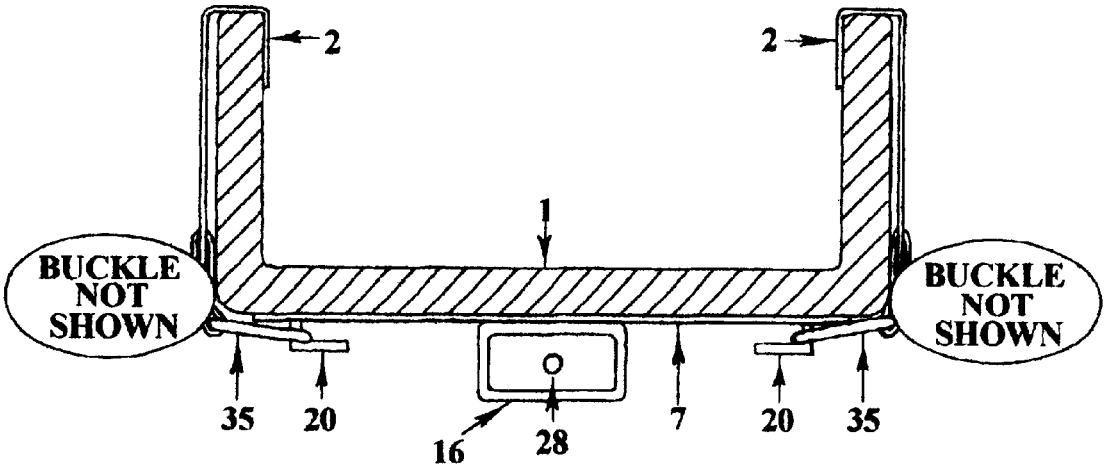
FIG. 17 is a view of the manner in which the attachment strap can be attached to one of the tie down plates.

Two spring loaded spring out legs 13 are attached to the central frame 16 adjacent the top tie down plate 7. The swing out legs are biased by torsion springs 25 as can be seen in FIGS. 13 and 14. The swing out legs hinge on threaded studs 18, which in the preferred embodiment are ¼—20 NC threads, with the aid of nylon flange bushings 23. The swing out legs are secured by ¼—20 NC acorn nuts 24 in the preferred embodiment. Spring leg holes 19, 39 are provided in the central frame tube 16 and in the swing out legs 13 for the torsion springs 25. The top tie down plate 7 acts as a back stop for the swing out legs 13 and keeps them from spreading too wide, stopping the legs in the open position. The spring loaded swing out legs 13 diverge at an angle from the central frame attachment point to the bottom of the legs. When the swing out legs 13 are in the unfolded or extended position they support the central frame 16 in conjunction with the two support legs 17 located at the bottom of the central frame so that the stand essentially forms a tripod to support an instrument case mounted thereon. Although the swing out legs 13 rotate about an axis perpendicular to the central frame 16 between a folded and an extended position, the two swing out legs 13 remain fixed to each other by a leg brace and latch plate 12 located near the bottom of each swing out leg 13.

The swing out legs 13 are held in the folded position by a latch 11 located near the base of the central frame 16. The latch 11 has a hook that extends from the rear of the central frame 16 and snaps over the leg brace and latch plate 12 to hold the swing out arms 13 in the folded position against the force exerted by the torsion springs 25. The latch 11 is attached to a connecting rod 28 that extends through the hollow tube forming the central frame 16 from the latch 11 to the top of the tube. A coil spring 27 extending around the top of the connecting rod 28 between a backing plate 30 fixedly attached to the tubular central frame 16 to a button 10 protruding from the top of the tubular central frame 16. By depressing the button 10 against the force exerted by the coil spring 27, the connecting rod 28 and the latch 11 are moved downward relative to the tubular central frame 16 so that the latch 11 is shifted so that it will be disengaged from the leg brace and latching plate 12.

A pull down clamp 5 located adjacent the top of the central frame 16 and support pegs 4 located adjacent the bottom provide means to engage the top and bottom of an instrument case 1 mounted on the stand 3. The top pull down clamp 5 is adjustable and is mounted on a bracket that extends around the central frame 16 and can be secured to the frame at different locations by a lock down screw that has a lock down hand nob attached to the end and protruding from the rear of the tubular central frame 16. The lock down screw is threaded in a weld nut 36 mounted on the telescoping bracket.

Referring to FIG. 1, an instrument case is attached by tie-down straps and clips 2 to the attachable, folding instrument case stand. As shown in FIG. 1, the stand can be folded flat against the back of the instrument case. A pull down clamp 5 pulls on the top of the instrument case and holds it against support pegs 4. This helps to keep the stand secured to the case and from slipping either up or down. The lock down hand knob 6 holds the pull down clamps in place.

To operate the stand, one takes hold of the handle 9, which is attached to the stand via handle straps 26 and holds the stand upright. Then one presses the push button 10, which is located under the handle and is connected to the latch 11 by a connecting rod 28, which in the preferred embodiment is a rod having an outer diameter of ⅛ inch. This releases the spring loaded spring out legs 13.

Figure 8:
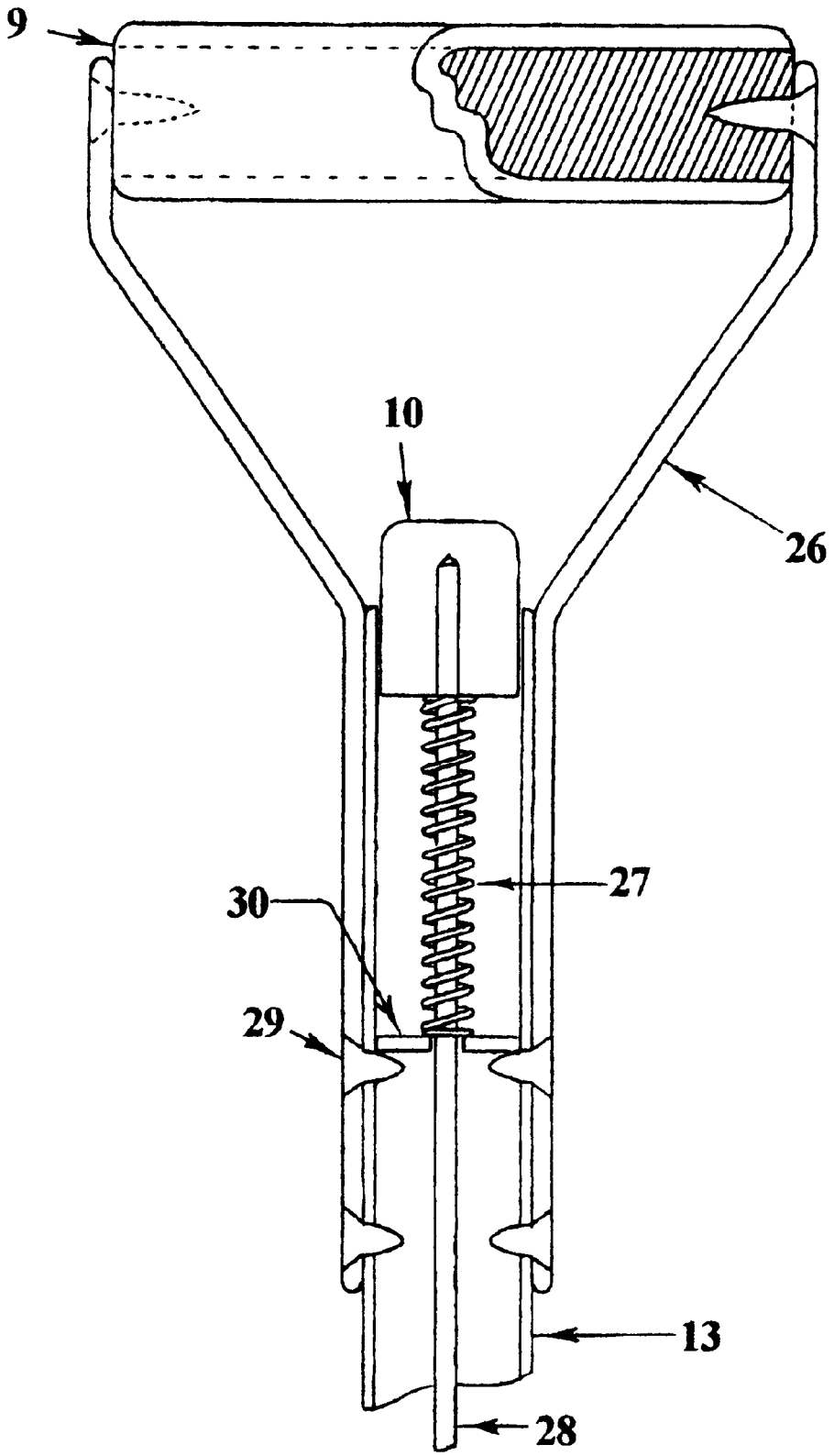
FIG. 8 is a partial section view of the top of the central frame showing the coil spring biasing the connection rod to maintain the latch located at the bottom of the central frame in position.
Figure 9:
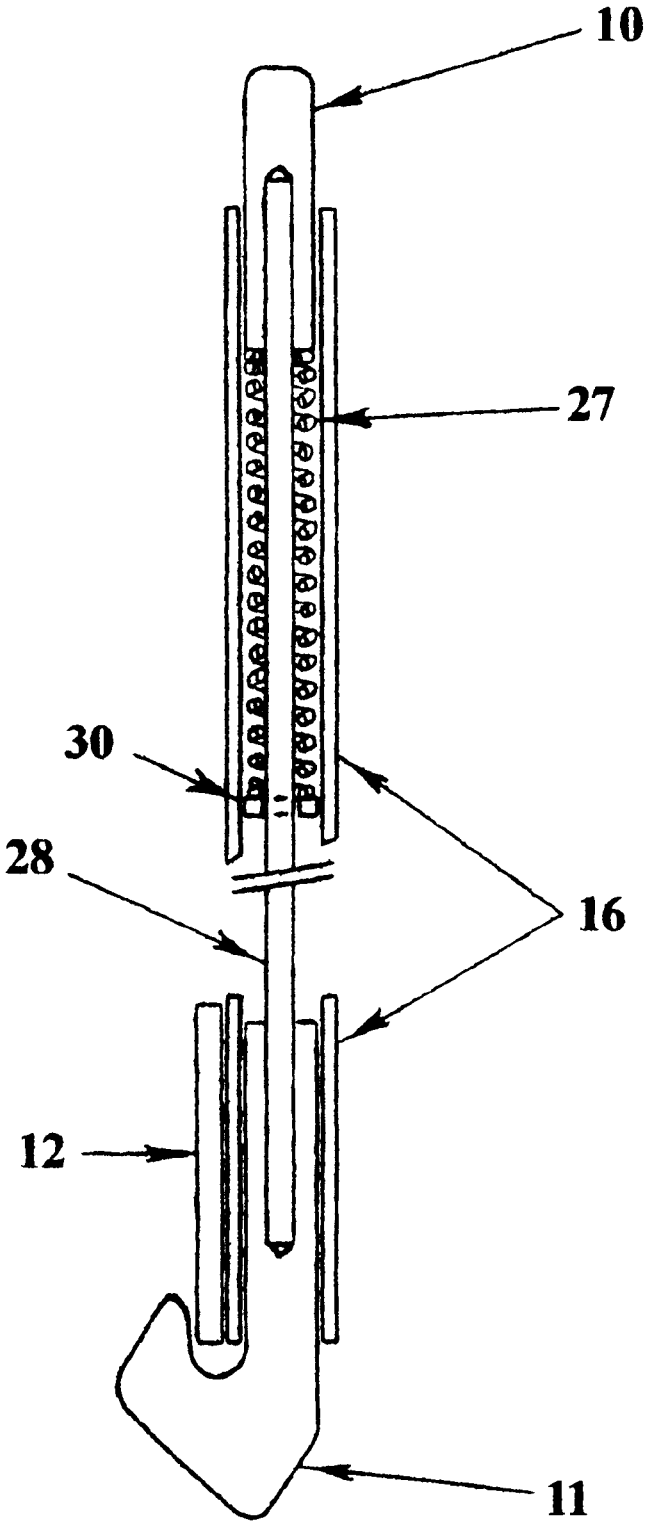
FIG. 9 is a section view, in which the central portion of the frame has been removed for clarity, showing the spring loaded connecting rod and the latch to which this rod is attached.
Figure 10:
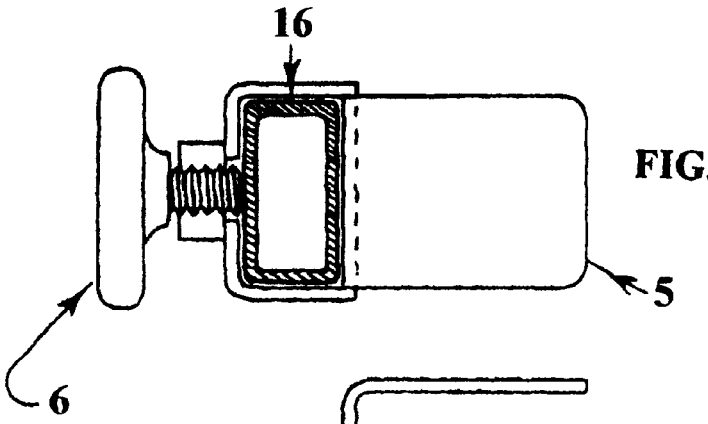
FIG. 10 is a section view showing the top tie down clamp and the lock down screw that secures it at different positions so that the clamp is adjustable for instrument cases of differing heights.
Figure 11:
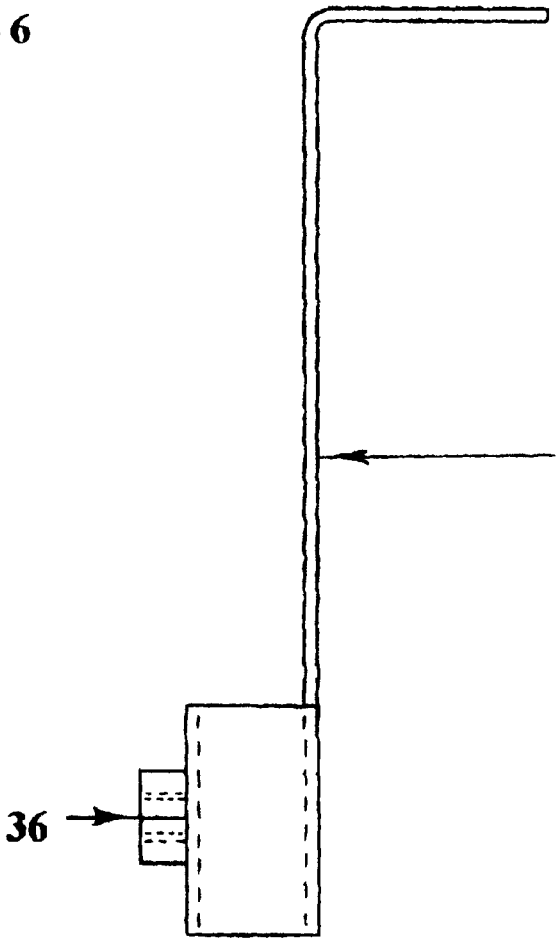
FIG. 11 is a side view of the top tie down clamp assembly shown in FIG. 10.
Figure 12:
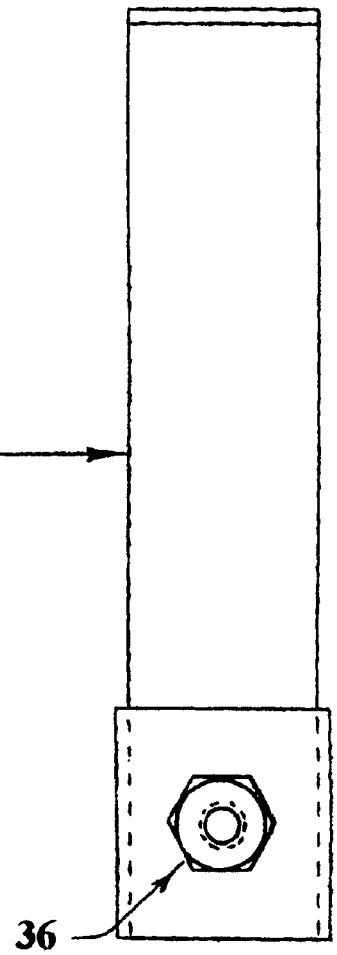
FIG. 12 is a rear view of the top tie down clamp assembly shown in FIGS. 10 and 11.

To close one uses the handle 9 to hold the stand erect and uses a foot to press against the leg brace and latch plate 12 to cause the latch to engage and hold the swing out legs 13 in the closed position. A coil spring 27, as seen in FIGS. 8 and 9 exerts force between the spring backing plate 30 and the push button 10. The spring backing plate 30 is held in place by two of the sheet metal screws 29 that hold the handle straps 26 to the central frame tube 16.

Figure 2:
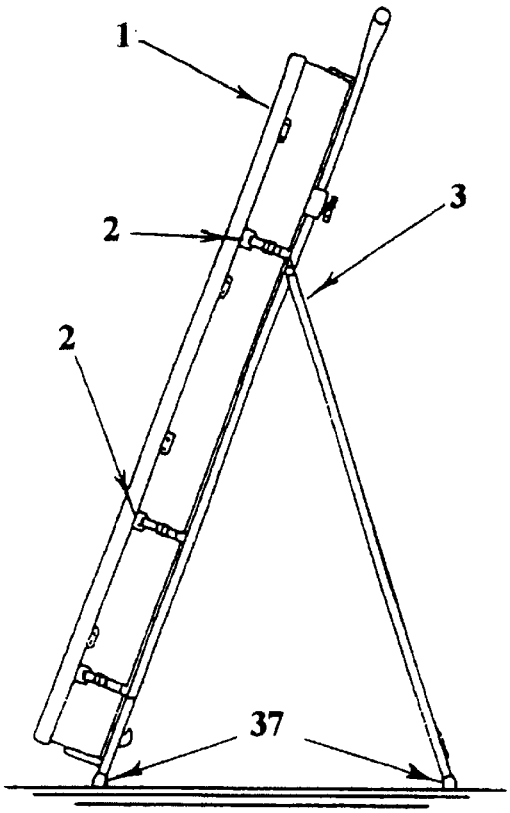
FIG. 2 is a side view of the stand attached to the guitar case in its unfolded or extended position. Also shown are tie-down straps, clips and rubber feet.
Figure 3:
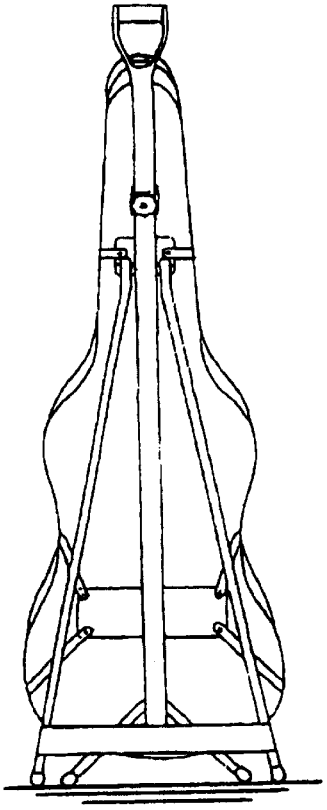
FIG. 3 is a rear view of the stand attached to a guitar case in the unfolded or extended position of FIG. 2.
Figure 4:
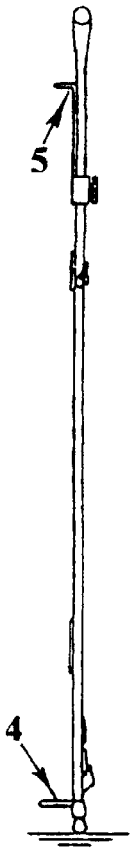
FIG. 4 is a side view of the stand without an instrument case attached to it, exposing the support pegs and pull down clamp.
Figure 5:
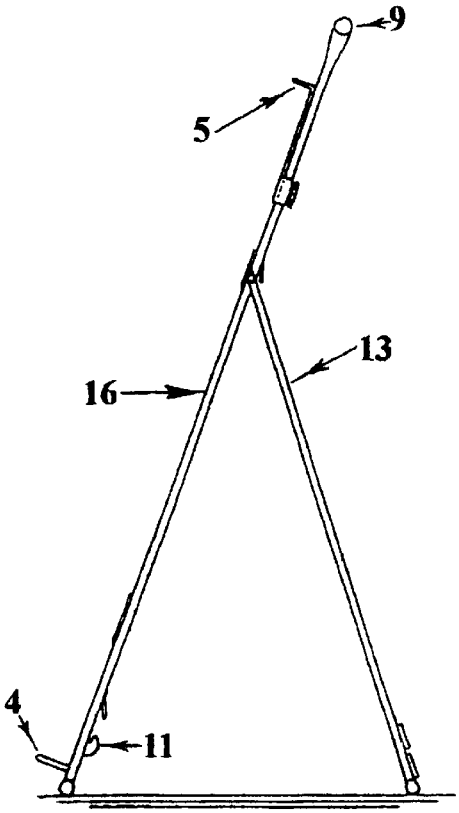
FIG. 5 is a side view of the stand in its unfolded or extended position without the instrument case attached showing the handle, pull down clamp, support pegs, latch and spring loaded legs, also referred to a swing out legs.
Figure 6:
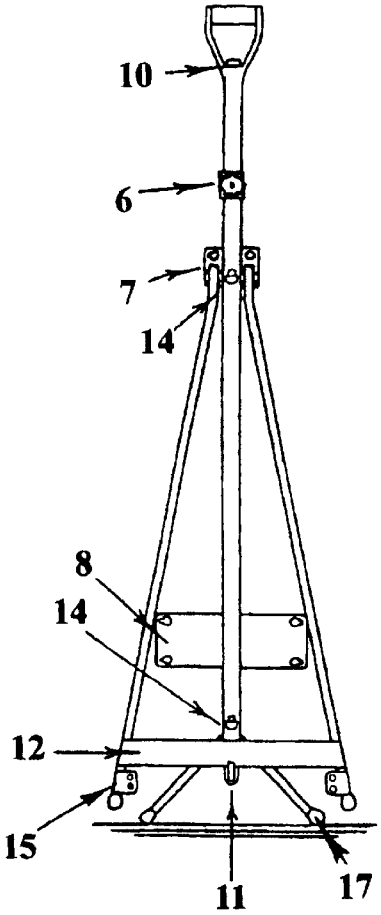
FIG. 6 is a rear view of the stand without the instrument case attached exposing the leg release button, the lock down hand knob, top tie down plate and bottom tie down plate along with both shoulder strap D rings, leg brace and latch plate, caster mounting plates, latch and central spring frame legs.
Figure 7:
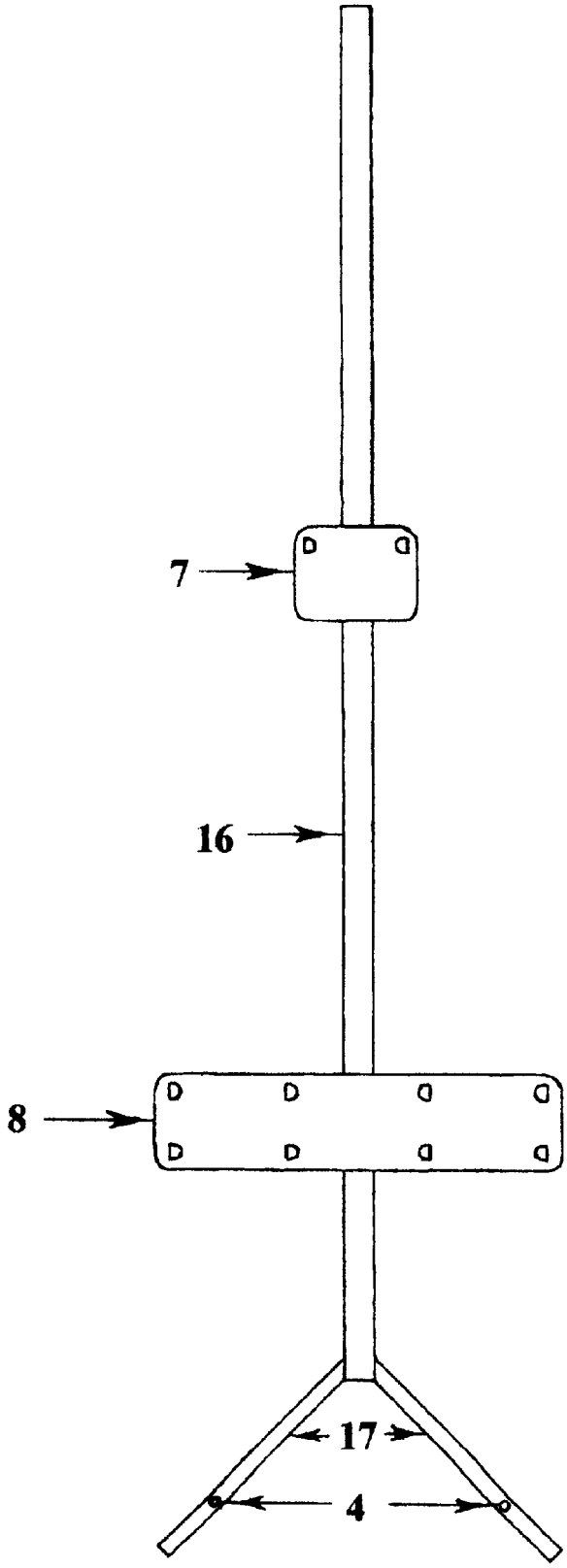
FIG. 7 is a front view of the central frame with the tie down plate central steel tube, bottom tie down plate, central frame legs and support pegs.

As can be seen in FIGS. 2, 6 and 7, the top tie down plate 7 and the bottom tie down plate 8 are where the tie down straps and clips 2 are attached to the stand. The tie down strap assembly 2 consists of a thin gauge metal flat hook connected to a web strap 33 fabricated from a material, such as nylon or polypropylene. The web strap then runs through a buckle 34 which is attached via a web strap 33 to a D ring 35. The flat hooks 2 slip over the edges of the instrument case 1 and via the straps 33 connect to the extruded hooks 20 in the top and bottom tie down plates. The buckles allow for the straps to be tensioned and also allow for flexibility in the size and type of instrument case.

Two D rings 14 are provided for the use of a shoulder strap (not shown) to provide convenience for carrying the entire assembly. Caster mounting plates 15 are provided for the attachment of a retrofit caster kit (not shown) that will add further convenience by allowing one to pull the entire assembly like a cart.

Rubber feet caps 37 on the ends of the legs provide traction on slick surfaces while also providing scuff and abrasion protection.

The preferred embodiment of this invention is specifically intended for use with a guitar case. Representative dimensions have been included in certain attached drawings. These dimensions would be for use with a guitar case stand, and these dimensions are representative only and should not be considered as limiting. Of course these dimensions and other details of this embodiment would be altered for use with other instruments. For example, this stand could easily be adapted to other string instrument, such as smaller violins or violas, or it could be adapted for use with larger string instruments, such as a cello or bass violin. The stand is adjustable and could also be used with other instruments as well. For example, a stand that would be suitable for use with a guitar or banjo should also be suitable for use with a woodwind or brass instrument of approximately the same size. Furthermore modifications to the basic stand would be apparent to one of ordinary skill in the art. For example, modifications could be made to adapt this stand for use with a case for instruments having a shape quite different from a guitar. Therefore the preferred embodiment of the invention depicted herein should be considered to be representative only and the invention is defined by the following claims.

I claim:

1. A folding stand attachable to a musical instrument case for supporting the musical instrument case; the folding stand comprising:

a central frame member;

an upper clamping member mounted on the central frame member comprising means for engaging the musical instrument case on a top surface thereof, and a lower clamping member mounted on the central frame below the upper clamping member and comprising means for engaging the musical instrument case on a bottom surface thereof, at least one of the upper or lower clamping members being adjustable for use with instrument cases having different heights;

a pair of swing out legs pivotal relative to the central frame member between a folded position and an extended position with the swing out legs extending transverse to the central frame member in the extended position so that the pair of swing out legs and the central frame support the stand and the musical instrument case mounted thereon;

a latch located on the central frame, the latch being shiftable between a first and a second position so that when the latch is in the first position the latch is in a position to retain the swing out legs in the folded position, wherein a combination leg brace and latch plate extends between the swing out legs, the latch being engagable with the combination leg brace and latch plate when the swing out legs are in the folded position wherein the latch is mounted on a connecting rod that extends toward the top of the central frame, with the latch being shiftable from a first latching position to a second retracted position by applying a force to the connecting rod adjacent to the top of the central frame.

2. The folding stand of claim 1 wherein the stand supports the musical instrument case in a upright, tilted position when the swing out legs are in the extended position.

3. The folding stand of claim 1 wherein the swing out legs mutually diverge and the each diverges relative to the central frame.

4. The folding stand of claim 1 wherein the swing out legs are spring loaded relative to the central frame.

5. The folding stand of claim 1 wherein the latch is spring loaded relative the central frame.

6. The folding stand of claim 1 wherein the latch is located on a lower portion of the central frame.

7. The folding stand of claim 1 wherein the central frame comprises a tubular member and the connecting rod extends through the tubular member.

8. The folding stand of claim 1 wherein the swing out legs are attached to the central frame by studs on either side of the central frame and wherein torsion springs bias the swing out legs toward the extended position.

9. The folding stand of claim 1 wherein upper and lower tie down plates are located one above the other on the central frame with straps attachable to the tie down plates securing the musical instrument case to the stand.

10. The folding stand of claim 9 wherein the swing out legs are mounted on the central frame adjacent to the top tie down plate, the swing out legs engaging the top tie down plate when fully extended so that the top tie down plate acts as a backstop for the swing out legs.

11. The folding stand of claim 1 wherein caster plates for mounting casters are located on the bottom of the central frame and a handle is located on the top of the central frame so that the stand can be employed to roll the musical instrument case from place to place.

12. The folding stand of claim 1 wherein the swing out legs are configured for supporting a guitar case mounted on the stand.

13. A portable stringed instrument case stand for use with a stringed instrument case having a cover hinged relative to an instrument case base, both the cover and the base having opposed rims which meet to close the instrument case, the stand comprising:

an upper tie down plate and a lower tie down plate;

straps extending from the upper tie down plate and the lower tie down plate, each strap having a hook for engaging the rim on the instrument case base, when the instrument case is in either open or closed positions;

upper and lower clamps for respectively engaging a top surface and a bottom surface on the instrument case base, at least one of the upper and lower clamps being adjustable relative to the tie down plates; and three supporting members extending below the bottom tie down plate to form a tripod mounting configuration, two of the supporting members comprising legs pivotal relative to the third supporting member between an extended position and a folded position so that the stand can be mounted on the instrument case and transported with the support members in a folded position and with the instrument case cover in the closed position to transport a stringed musical instrument therein, the third support member comprising a central frame member with lower support legs diverging relative to the central frame member, the two support legs being smaller than the two pivotal legs and;

a latch shiftable between a first and a second position so that when the latch is in the first position the latch is in a position to retain the two supporting members in the folded position, wherein a combination leg brace and latch plate extends between the two supporting members, the latch being engagable with the combination leg brace and latch plate when the two supporting members are in the folded position.

14. The stand of claim 13 wherein the tie down plates and the swing out legs are each mounted on the central frame.

15. A portable musical instrument stand for temporarily holding a musical instrument comprising:

a musical instrument case having a cover and a base, the base being configured to support the musical instrument;

a folding stand attachable to the instrument case base and including diverging legs pivotal relative to a central frame between a folded and an unfolded configuration, the legs diverging from the central frame in the unfolded configuration to support the musical instrument in an upright, tilted orientation, and;

a latch located on the central frame, the latch being shiftable between a first and a second position so that when the latch is in the first position the latch is in a position to retain the diverging legs in the folded configuration, wherein a combination leg brace and latch plate extends between the diverging legs, the latch being engagable with the combination leg brace and latch plate when the diverging legs are in the folded configuration, wherein the latch is mounted on a connecting rod that extends toward a top surface of the central frame, with the latch being shiftable from a first latching position to a second retracted position by applying a force to the connecting rod adjacent to the top surface of the central frame.

* * * * *